US005532930A

United States Patent [19]

Kako

[11] Patent Number: 5,532,930

[45] Date of Patent: Jul. 2, 1996

[54] ENGINE-CONTROLLING ATMOSPHERIC PRESSURE DETECTION SYSTEM

[75] Inventor: Hajime Kako, Himeji, Japan

[73] Assignee: Mitsubishi Denki Kabushiki Kaisha, Tokyo, Japan

[21] Appl. No.: 332,778

[22] Filed: Nov. 1, 1994

[30] Foreign Application Priority Data

Nov. 4, 1993 [JP] Japan ..... 5-275602

[51] Int. Cl.[6] ..... F02D 41/18

[52] U.S. Cl. ..... 364/431.05; 123/380; 364/558

[58] Field of Search ..... 364/431.05, 558, 364/431.04; 123/380, 382, 391, 488

[56] References Cited

U.S. PATENT DOCUMENTS 4,590,563 5/1986 Matsumura et al. ..... 364/431.05
4,748,955 6/1988 Yonekawa et al. ..... 123/479
4,864,998 9/1989 Onishi ..... 123/489
5,315,979 5/1994 Kako ..... 123/478
5,383,430 1/1995 Kamiya ..... 123/339

FOREIGN PATENT DOCUMENTS 191836 7/1990 Japan .

*Primary Examiner*—Michael Zanelli
*Attorney, Agent, or Firm*—Sughrue, Mion, Zinn, Macpeak & Seas

[57] ABSTRACT

An engine-controlling atmospheric pressure detection system which is capable of detecting atmospheric pressure highly frequently, even during descending, based on a signal from a pressure sensor for detecting air-intake pressure. An actual air-intake pressure is normalized in relation to air-intake pressures at high and low altitudes, respectively, when a throttle valve is closed, which pressures have been stored in a ROM, thereby determining the resultant value as a parameter. The atmospheric pressure is thus detected from the minimum value of such a parameter.

7 Claims, 9 Drawing Sheets

FIG. 13(a)
FIG. 13(b)
FIG. 13(c)
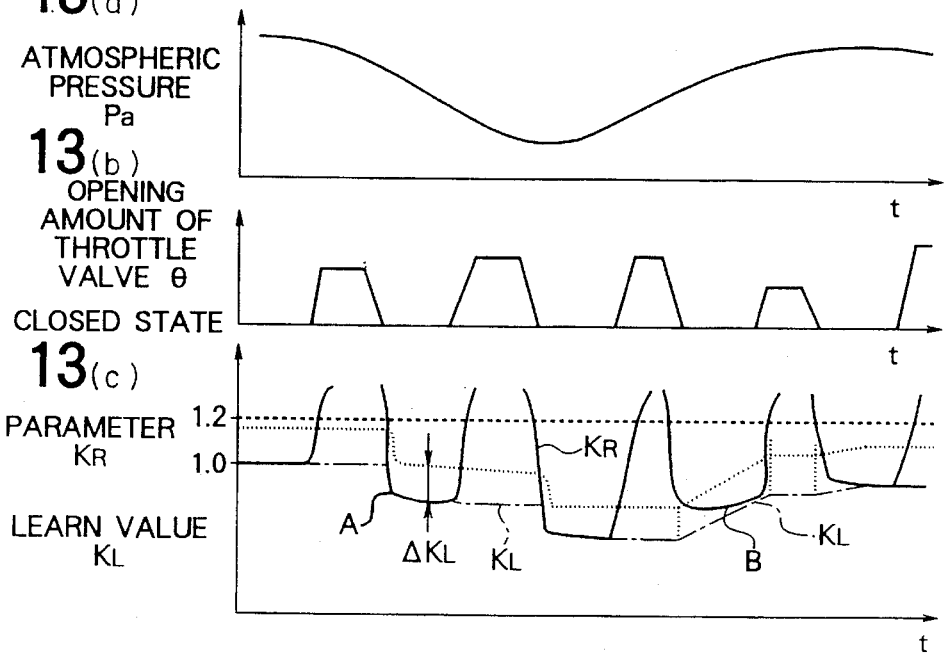
FIG. 14
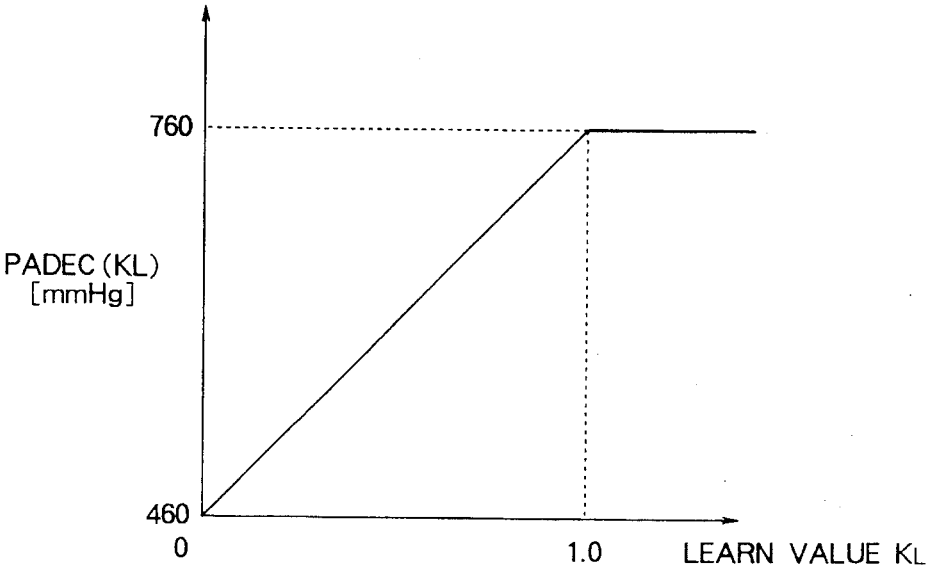

ENGINE-CONTROLLING ATMOSPHERIC PRESSURE DETECTION SYSTEM

BACKGROUND OF THE INVENTION

FIELD OF THE INVENTION

The present invention relates to an engine-controlling atmospheric pressure detection system which is capable of detecting atmospheric pressure without requiring an atmospheric pressure sensor.

DESCRIPTION OF THE RELATED ART

In general, in order to cope with a high load in a high-load region in excess of a certain point (an air fuel mixture enriching region), a conventional engine control unit increases output by enriching an air fuel mixture. The determination of whether the engine air fuel mixture is in such an enriching region depends on whether the air-intake tube pressure of an engine is equal to or greater than the value obtained by subtracting a predetermined value ΔPE (for example, 50 mmHg) from atmospheric pressure. Hence, the detection of the atmospheric pressure is essential in an engine fuel control unit of this type.

A conventional engine-controlling atmospheric pressure detection system is known such as the one disclosed in Japanese Patent Publication No: 2-59293. The system disclosed in this publication is constructed and operated as follows. The system comprises a pressure sensor for detecting the air-intake tube pressure of an engine and a throttle sensor for detecting whether a throttle valve is fully opened. The air-intake tube pressure detected when the throttle valve is fully opened and the engine speed is low is stored and kept as atmospheric pressure. The two types of pressures, that is, the air-intake tube pressure and atmospheric pressure, can be measured with a single pressure sensor.

However, the conventional atmospheric pressure detection system of this type presents the following problems. The detection system is easily able to detect the atmospheric pressure during ascension when the throttle valve is often fully opened, while it is hardly able to detect the atmospheric pressure during descending When the throttle valve is seldom fully opened. Also, a throttle sensor is required to detect whether the throttle valve is fully opened, thus making a detection system expensive in an engine control system which otherwise would not require such a throttle sensor.

SUMMARY OF THE INVENTION

Accordingly, in order to overcome the above drawbacks, an object of the present invention is to provide an inexpensive engine-controlling atmospheric pressure detection system which is capable of detecting the atmospheric pressure highly frequently without requiring a throttle sensor, even during descending, based on a signal from a pressure sensor for detecting the air-intake tube pressure.

In order to achieve the above objects, according to one aspect of the present invention, there is provided an engine-controlling atmospheric pressure detection system comprising: engine speed calculation means for calculating a speed of an engine; pressure detection means for detecting air-intake tube pressure of the engine; first pressure calculation means for calculating a first pressure according to at least the engine speed, the first pressure being associated with the air-intake tube pressure when a throttle valve of the engine is closed; second pressure calculation means for calculating a second pressure according to at least the engine speed, the second pressure being associated with the air-intake tube pressure when the throttle valve of the engine is closed; parameter calculation means for calculating a parameter which indicates the relationship of the air-intake tube pressure in relation to the first and second pressures; learn value calculation means for processing the parameter in time sequence by calculation so as to determine a typical value of the parameter and to store the typical value as a learn value; and atmospheric pressure calculation means for calculating an atmospheric pressure based on the learn value.

In a preferred form of the invention, the first pressure calculation means may calculate as the first pressure a value associated with the air-intake tube pressure at a high altitude when the throttle valve is closed, and the second pressure calculation means may calculate as the second pressure a value associated with the air-intake tube pressure at a low altitude when the throttle valve is closed.

In another preferred form of the invention, the first pressure may be calculated based on typical valve-closed air-intake pressures PBHZ (Ne) and PBHF (Ne) when a bypass air flow rate is 0 and 256 liter/minute, respectively, at an atmospheric pressure of 460 mmHg and at an altitude of 4000 m, the pressures PBHZ (Ne) and PBHF (Ne) having been stored as high altitude air-intake tube pressures.

In a further preferred form of the invention, the second pressure may be calculated based on typical valve-closed air-intake pressures PBLZ (Ne) and PBLF (Ne) when a bypass air flow rate is 0 and 256 liter/minute, respectively, at an atmospheric pressure of 760 mmHg and at an altitude of 0 m, the pressures PBLZ (Ne) and PBLF (Ne) having been stored as low altitude air-intake tube pressures.

In a further preferred form of the invention, the parameter calculation means calculate as a parameter a ratio of a value obtained by subtracting the first pressure from the air-intake tube pressure in relation to a value obtained by subtracting the first pressure from the second pressure, the learn value calculation means storing, when the parameter is smaller than the learn value, the parameter as the learn value, the learn value calculation means increasing, when the parameter is not smaller than the learn value and is also smaller than a predetermined value, the learn value and storing it.

In a further preferred form of the invention, the atmospheric pressure calculation means may determine an atmospheric pressure by forming a map of the learn value.

In a further preferred form of the invention, the atmospheric pressure calculation means may determine the atmospheric pressure when the learn value is 0 as the atmospheric pressure at a high altitude and may determine the atmospheric pressure when the learn value is 1 as the atmospheric pressure at a low altitude.

The engine-controlling atmospheric pressure detection system is operated as follows. The first and second pressures corresponding to the air-intake pressure when the throttle valve is closed are calculated according to at least the engine speed. A parameter representing the relationship of the air-intake pressure in relation to the first and second pressures is calculated. The parameter is further processed by calculation in time sequence so as to find a typical value of the parameter and to store it as a learn value. Based on such a learn value, the atmospheric pressure is calculated. The atmospheric pressure can thus be detected highly frequently even while the engine speed is reduced during descending.

Further, the high-altitude pressure and the low-altitude pressure corresponding to the air-intake pressure when the throttle valve is closed are calculated according to at least the engine speed. A parameter representing the relationship of the air-intake pressure in relation to the high-altitude pressure and the low-altitude pressure is calculated. The parameter is processed by calculation in time sequence so as to find a typical value of the parameter and to store it as a learn value. Based on such a learn value, the atmospheric pressure is calculated. The atmospheric pressure can thus be detected highly frequently with high precision even while the engine speed is reduced during descending.

BRIEF DESCRIPTION OF THE DRAWINGS

FIGS. 13(*a*), 13(*b*) and 13(*c*) are timing charts of the operation for detecting atmospheric pressure according to the embodiment of the present invention; and FIG. 14 is a diagram indicative of the relationship between the learn value and the detected atmospheric pressure according to the embodiment of the present invention.

DESCRIPTION OF THE PREFERRED EMBODIMENT

Figure 1:
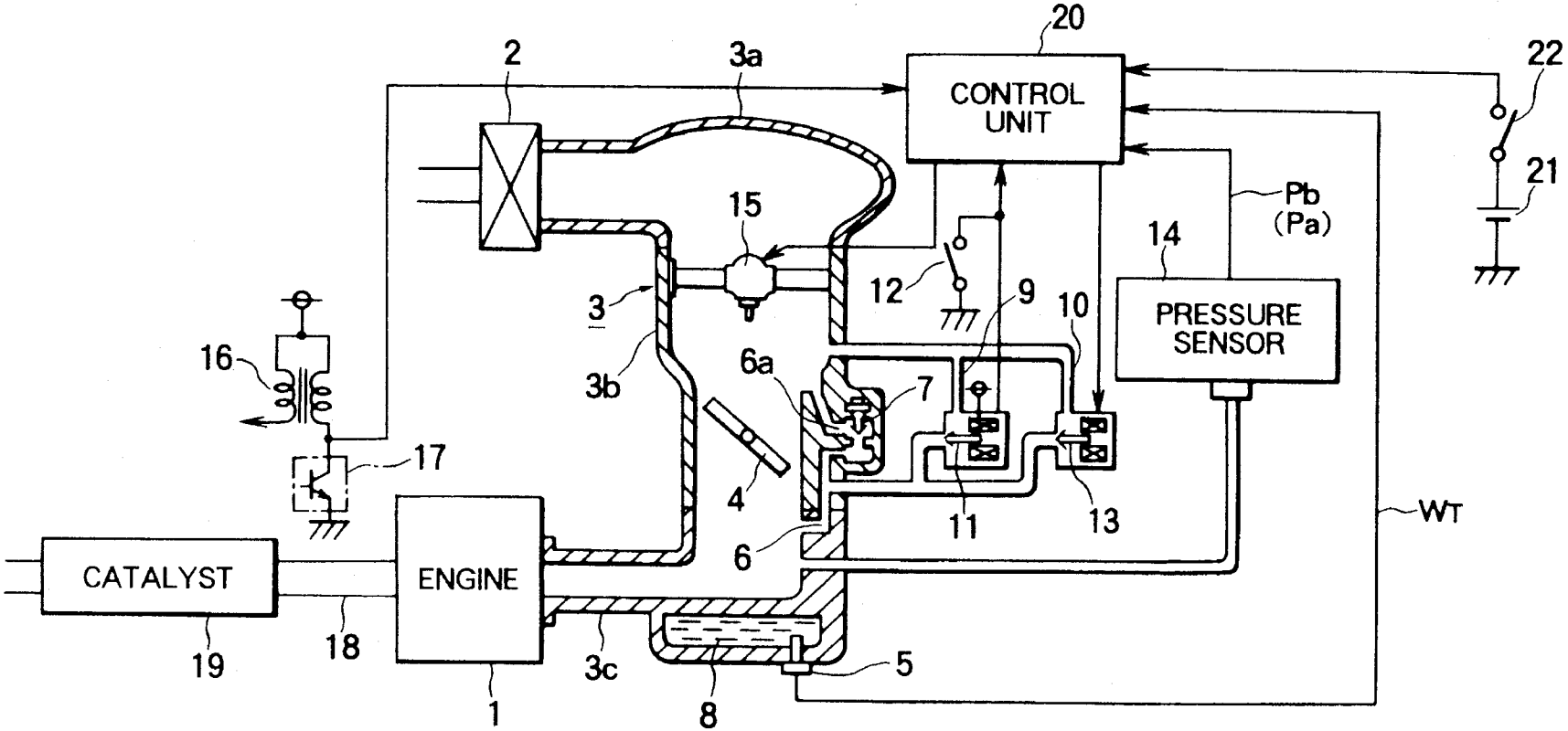
FIG. 1 is a schematic view of an overall detection system according to one embodiment of the present invention.

A first embodiment of the present invention will now be described with reference to the drawings. FIG. 1 is a schematic view of the overall construction of the present invention which is applied to an engine of the type in which fuel is controlled by a speed density system SPI (single point injection).

FIG. 1 illustrates a known spark ignition-type engine 1 mounted in, for example, an automobile, an air cleaner 2 for cleaning intake air, an air-intake tube 3 for allowing intake air to pass via the air cleaner 2, and a throttle valve 4 arranged in the air-intake tube 3 so as to adjust the amount of intake air. The engine 1 largely draws combustion air from upstream via the air cleaner 2, the air-intake tube 3 and the throttle valve 4.

The air-intake tube 3 comprises, starting from upstream, an air-intake portion 3*a*, a throttle body portion 3*b* whose opening sectional area is adjusted by the throttle valve 4, and an air-intake manifold portion 3*c*.

A water-temperature sensor 5 for detecting the temperature of cooling water 8 outputs a detection signal in accordance with the detected water temperature.

A bypass air passage 6 is arranged to bypass the throttle valve 4 within the throttle body portion 3*b*. A first inlet and the outlet of the bypass air passage 6 are respectively arranged further upstream and downstream of the throttle valve 4 within the throttle body portion 3*b*. A fast idle air passage 6*a* (hereinafter referred to as the FIA passage) is provided for the bypass air passage 6.

A wax-type fast idle air valve 7 (hereinafter referred to as the FIA valve) is arranged enroute to the FIA passage 6*a*. The cooling water 8 covers the outer periphery of the engine 1. The FIA valve 7 automatically adjusts the sectional area of the FIA passage 6*a* according to the temperature of the cooling water 8, thereby controlling part of the bypass air flow rate.

A second inlet of the bypass air passage 6 is positioned further upstream in the throttle body 3*b* than the foregoing first inlet. The bypass air passage 6 is integrally formed with an air-conditioner bypass passage 9 and an idle speed control bypass passage 10 (hereinafter referred to as the ISC bypass passage) which are connected in parallel to each other. The common outlet of the bypass passages 9 and 10 is positioned downstream of the FIA valve 7 provided for the FIA passage 6*a*.

The air-conditioner bypass passage 9 is provided with an air-conditioner idle-up solenoid valve 11 (hereinafter referred to as the ACIUS valve) for controlling the opening sectional area of the bypass passage 9. An air-conditioner switch 12 is arranged between the ACIUS valve 11 and a control unit 20 so as to be manipulated by an automobile driver. The ACIUS valve 11 is fully opened and closed according to the on/off operation of the air-conditioner switch 12, thereby controlling part of the bypass air flow rate. The bypass air flow rate when the ACIUS valve 11 is fully opened can be manually controlled in accordance with an air-conditioner load.

The ISC bypass passage 10 is provided with an idle speed control solenoid valve (hereinafter referred to as the ISC solenoid valve) 13 for controlling the opening sectional area of the bypass passage 10. The opening amount of the ISC solenoid valve 13 is adjusted according to the duty ratio of a drive signal, thereby controlling part of the bypass air flow rate in order to achieve, for example, the targeted engine speed at idle.

According to the construction as described above, the opening sectional area of the bypass air passage 6 (effective sectional area of the bypass air passage) is controlled by the FIA valve 7, the ACIUS valve 11 and the ISC solenoid valve 13, thereby controlling the overall bypass air flow rate.

The bypass air passing through the bypass air passage 6 is introduced into the engine 1 so as to be burned.

The pressure intake inlet of a pressure sensor 14 is arranged further downstream than the outlet of the bypass air passage 6 so as to detect the pressure Pb within the air-intake tube 3 (the air-intake tube pressure) as an absolute value and to output a detection signal in response to the detected air-intake tube pressure Pb.

A single injector 15 is arranged further upstream in the throttle body portion 3*b* than the first and second inlets of the bypass air passage 6. Such an injector 15 is connected to a fuel system (not shown) so as to inject and supply the fuel according to the opening amount of the throttle valve 4, which fuel corresponds to the amount of combustion intake air drawn into the engine 1. The fuel which has thus been injected and supplied is mixed with the intake air so as to form a gas mixture which is then introduced into the engine 1.

The ignition coil 16 is connected at the primary winding to a transistor at the final stage of an igniter 17, and a high voltage generated in the secondary winding is supplied to an ignition plug (not shown) provided for each cylinder of the engine 1, thereby performing ignition. The output signal from the primary winding of the ignition coil 16 is also used as an engine speed signal which is synchronized with the drive timing of the engine 1.

An exhaust gas cleaning catalyst 19 is arranged downstream of an exhaust gas pipe 18 of the engine 1. Accordingly, the exhaust gas from the engine 1 flowing through the exhaust gas pipe 18 has its harmful gas removed by the catalyst 19 and at least a part of the exhaust gas is exhausted into the atmosphere.

The control unit 20 comprises a microcomputer (which will be mentioned below) and other components. Based on various switching signals, sensor signals and other signals, the control unit 20 calculates the controlled variable of the engine speed at idle and the volume of fuel injection, and the like, by a predetermined calculation processing. Upon calculation of such variable and volume, the control unit 20 controls the driving of the ISC solenoid valve 13, the injector 15, and the like.

A battery 21 is connected to the control unit 20 via a key switch 22 so as to serve as a power supply source.

Figure 2:
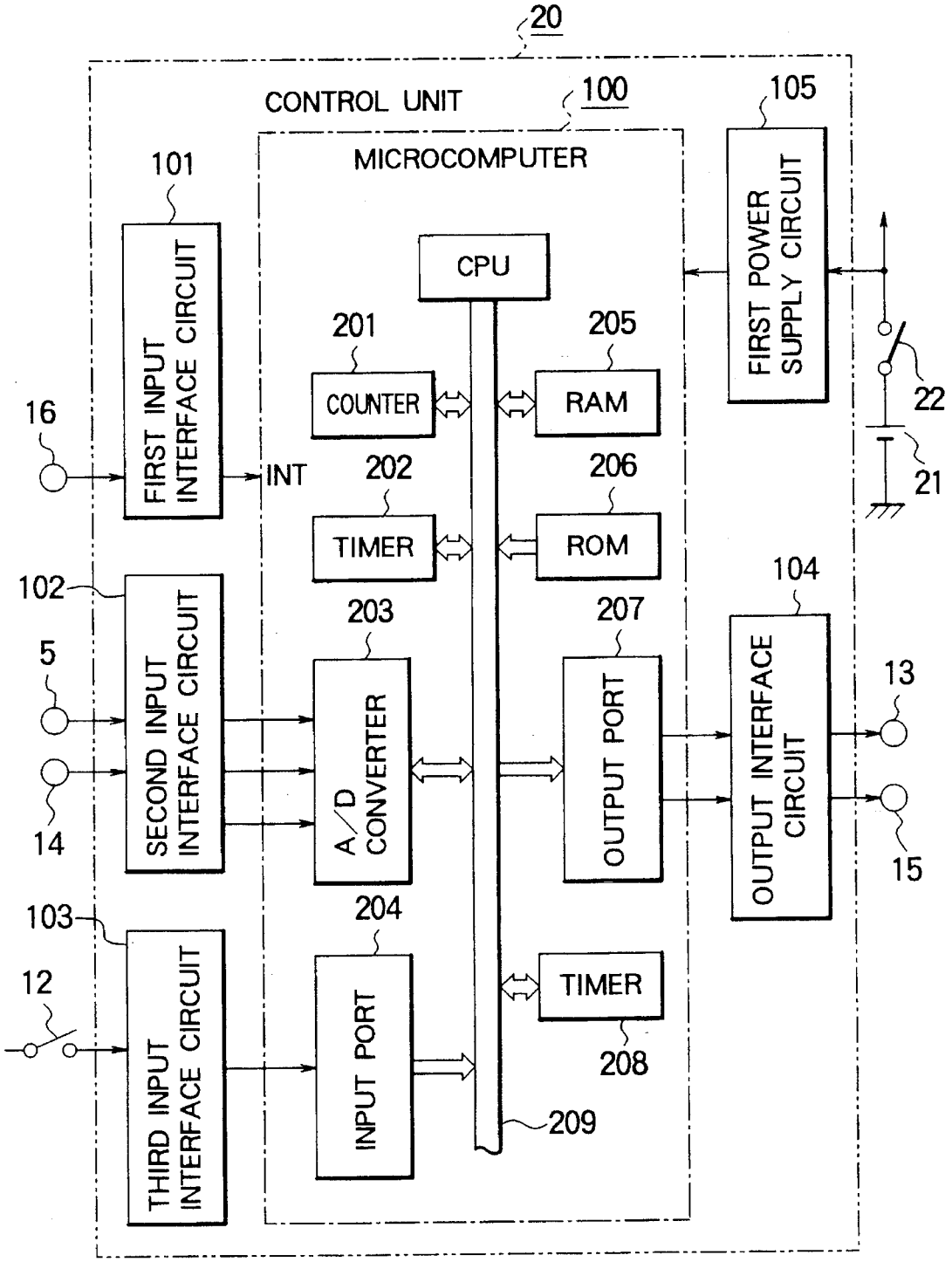
FIG. 2 is a block diagram of the internal construction of the control unit shown in FIG. 1.

FIG. 2 is a block diagram of the specific construction of the control unit 20 show a in FIG. 1. The control unit 20 includes: a microcomputer 100; first, second and third input interface circuits 101, 102 and 103 for inputting various signals into the microcomputer 100; an output interface circuit 104 for outputting as a control signal the calculation result from the microcomputer 100; and a first power supply circuit 105 for actuating the microcomputer 100.

The first input interface circuit 101 fetches a signal at the primary winding of the ignition coil 16; the second input interface circuit 102 fetches analog signals from the water temperature sensor 5 and the pressure sensor 14; and the third input interface circuit 103 fetches an on/off signal of the air conditioner switch 12. The output interface circuit 104 outputs control signals to the ISC solenoid valve 13 and the injector 15. The power source of the first power supply circuit 105 is supplied from the battery 21 via the key switch 22.

The microcomputer 100 comprises: a CPU 200 for executing various calculation processes, decisions, and the like; a counter 201 for measuring the speed cycle of the engine 1; a timer 202 for measuring the drive duration required for the control; an A/D converter 203 for converting an analog signal, which is input through the second interface circuit 102, into a digital signal; and an input port 204 for transmitting a digital signal, which is input through the third interface circuit 103, into the CPU 200.

The microcomputer 100 further comprises: a RAM 205 which serves the function of a work memory of the CPU 200; a ROM 206 for storing the main flow program for the operation (which will be mentioned below) of the CPU 200, various maps, and the like; an output port 207 for outputting a command signal of the CPU 200; a timer 208 for measuring a duty ratio of a drive signal which is supplied to the ISC solenoid valve 13; and a common bus 209 for connecting the CPU 200 with various components 201–208.

In the first embodiment of the present invention, the control unit 20 comprises: engine speed calculation means for calculating the engine speed Ne corresponding to the drive timing of the engine 1 which is synchronized with a signal from the primary winding of the ignition coil 16; pressure calculation means for calculating first and second pressures which relate to the air-intake tube pressure Pb when the throttle valve 4 within the air-intake tube 3 is closed, according to at least the engine speed Ne; parameter calculation means for calculating the parameter KR representing the relationship of the air-intake tube pressure Pb to the first and second pressures; learn value calculation means for calculating the parameter KR in time sequence to obtain a typical value and for storing such a typical value as a learn value KL; and atmospheric pressure calculation means for calculating the atmospheric pressure based on such a learn value.

The pressure calculation means determine the value PBH as a first pressure which corresponds to the air-intake tube pressure Pb at a high altitude when the throttle valve is closed and determine the value PBL as a second pressure which corresponds to the air-intake tube pressure Pb at a low altitude when the throttle valve is closed. The parameter calculation means calculate the ratio of a value obtained by subtracting the first pressure from the air-take tube pressure in relation to a value obtained by subtracting the first pressure from the second pressure so as to define such a ratio as the parameter KR. When the parameter KR is smaller than the latest learn value KL, the learn value calculation means store the parameter KR as a learn value KL. Conversely, when the parameter KR is equal to or greater than the learn value KL and is also smaller than a predetermined value (for example, 1.2), the learn value calculation means gradually increase the learn value KL and stores it. Also, when such a learn value is 0, the atmospheric pressure calculation means determine such a value 0 as an atmospheric pressure corresponding to a high altitude. On the other hand, when the learn value is 1, the atmospheric pressure calculation means determine such a value 1 as an atmospheric pressure corresponding to a low altitude.

A typical operation of the control unit 20 will now be described with reference to FIGS. 1 and 2.

An ignition signal obtained at the primary winding of the ignition coil 16 is subjected to waveform-shaping and the like through the first input interface circuit 101 so as to be transformed into an interruption command signal, which is then input into the microcomputer 100.

Every time an interruption occurs by such an interruption signal, the CPU 200 within the microcomputer 100 reads the value of the counter 201 so as to calculate the speed cycle of the engine 1 from the difference between the previous counter value and the updated value, and also to calculate the engine speed data Ne indicative of the engine speed.

Analog signals transmitted from the water temperature sensor 5 and the pressure sensor 14 undergo the removal of the noise components, the amplification, and other processing, through the second input interface circuit 102. The resultant signals are further converted through the A/D converter 203 into digital data which represent the air-intake pressure Pb indicating the pressure of the air-intake tube 3 and the cooling water temperature WT indicating the temperature of the cooling water 8, respectively. The air-intake tube pressure Pb is proportional to the detected pressure of the air-intake tube, and the cooling water temperature WT is proportional to the detected temperature of the cooling water.

An on/off signal from the air conditioner switch 12 is converted into a digital signal level through the third input interface circuit 103 and is theft input into the input port 204.

Based on the foregoing input data, the CPU 200 within the microcomputer 100 calculates the controlled variable of the bypass air, for example, every 100 ms, and also calculates the drive duration of the injector 15. By such means of synchronizing with the occurrence of an interruption command signal, the CPU 200 permits the timer 208 to measure the duration at a duty ratio corresponding to the controlled variable of the bypass air. Likewise, the CPU 200 allows the timer 202 to measure a duration corresponding to the fuel injection volume.

During the measurement of the timer 208 or the timer 202, a drive command is given to the output interface circuit 104 from the CPU 200 through the output port 207.

According to such a drive command, the output interface circuit 104 supplies a drive signal at the duty ratio described above to the ISC solenoid valve 13 so as to control the opening amount of the ISC solenoid valve 13. The output interface circuit 104 also supplies a drive signal to the injector 15 so as to drive the injector 15 to open for the calculated drive duration $\tau$.

When the key switch 22 is turned on, the first power supply circuit 105 adjusts the voltage of the battery 21 to a constant voltage, which is then supplied to the microcomputer 100, thereby actuating the microcomputer 100.

Figure 3:
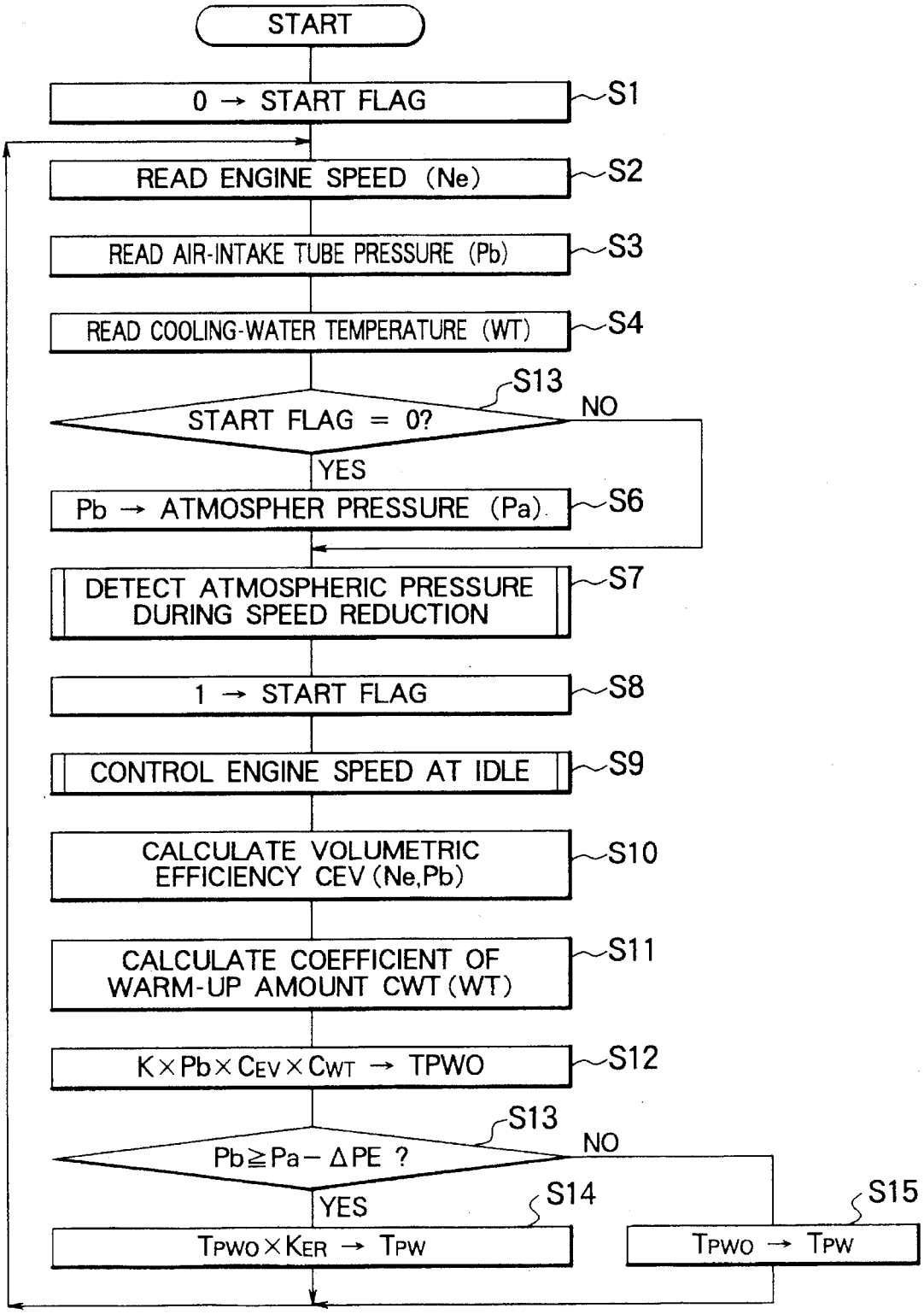
FIG. 3 is a flow chart of the operation of the embodiment according to the present invention.

A description will now be given of the operation of this embodiment according to the present invention with reference to FIG. 3. In FIG. 3 the key switch 22 is turned on to supply the power to the control unit 20 so as to allow the CPU 200 to start the operation. In step S1 the start flag indicating the completion of the initialization of the RAM 205 is first reset to 0.

The flow proceeds to step S2 in which the real engine speed data Ne indicative of the engine speed is determined from the speed cycle which has already been detected by the ignition signal from the ignition coil 16. Then, in step S3 the air-intake tube pressure Pb indicating the air-intake tube pressure detected by the pressure sensor 14 is read. In step S4 the cooling water temperature WT indicating the cooling-water temperature detected by the water temperature sensor 5 is read.

The flow proceeds to step S5 in which it is determined whether the start flag is 0. If the answer in step S5 is YES, the flow proceeds to step S6 in which the air-intake pressure Pb is stored into the RAM 205 as the detected atmospheric pressure Pa. If the answer in step S5 is NO, that is, if it is determined that the start flag is 1, or upon completion of the processing in step S6, the flow proceeds to step S7.

Figure 4:
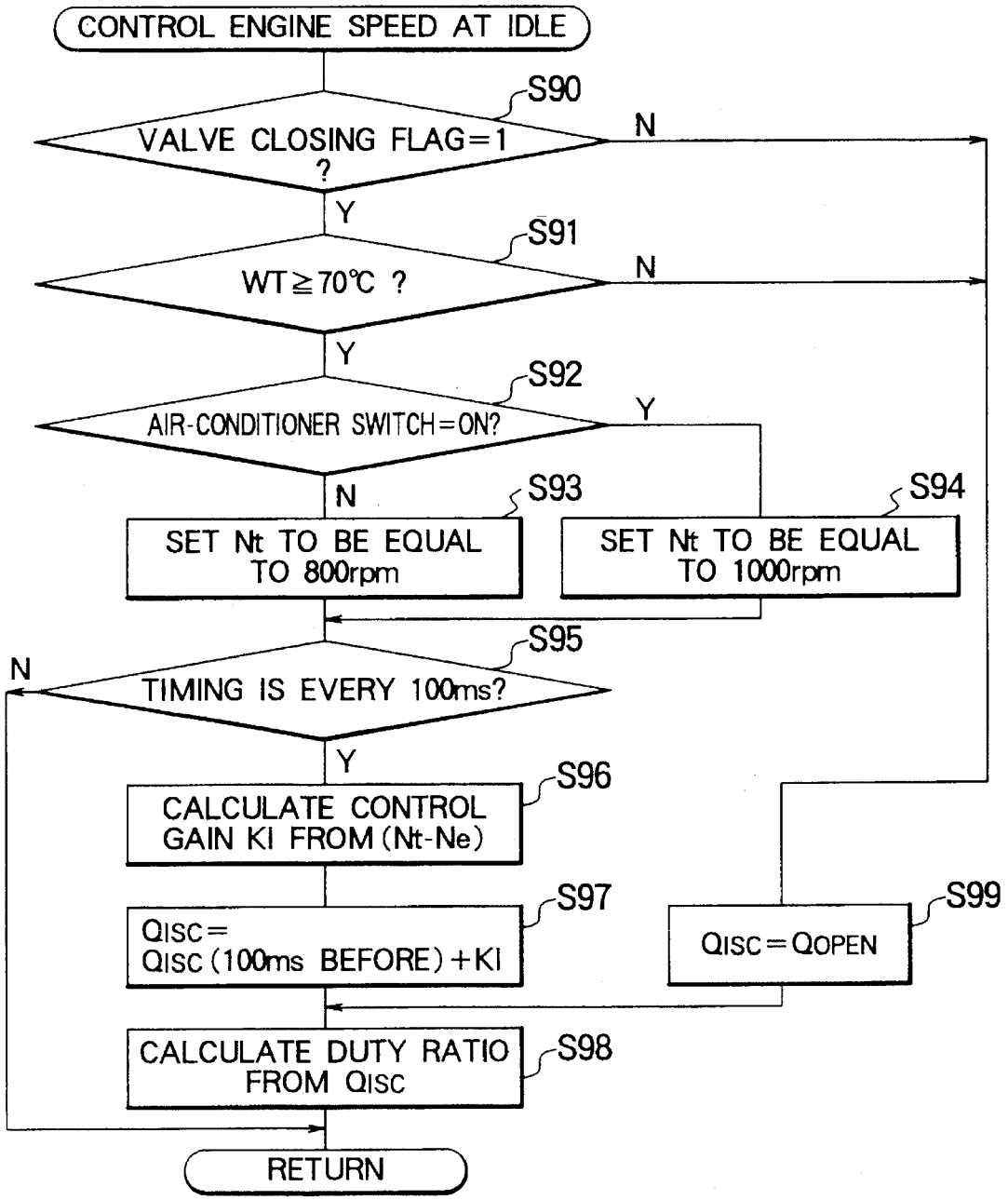
FIG. 4 is a flow chart of the processing of step S9 in the flow chart of FIG. 3.
Figure 5:
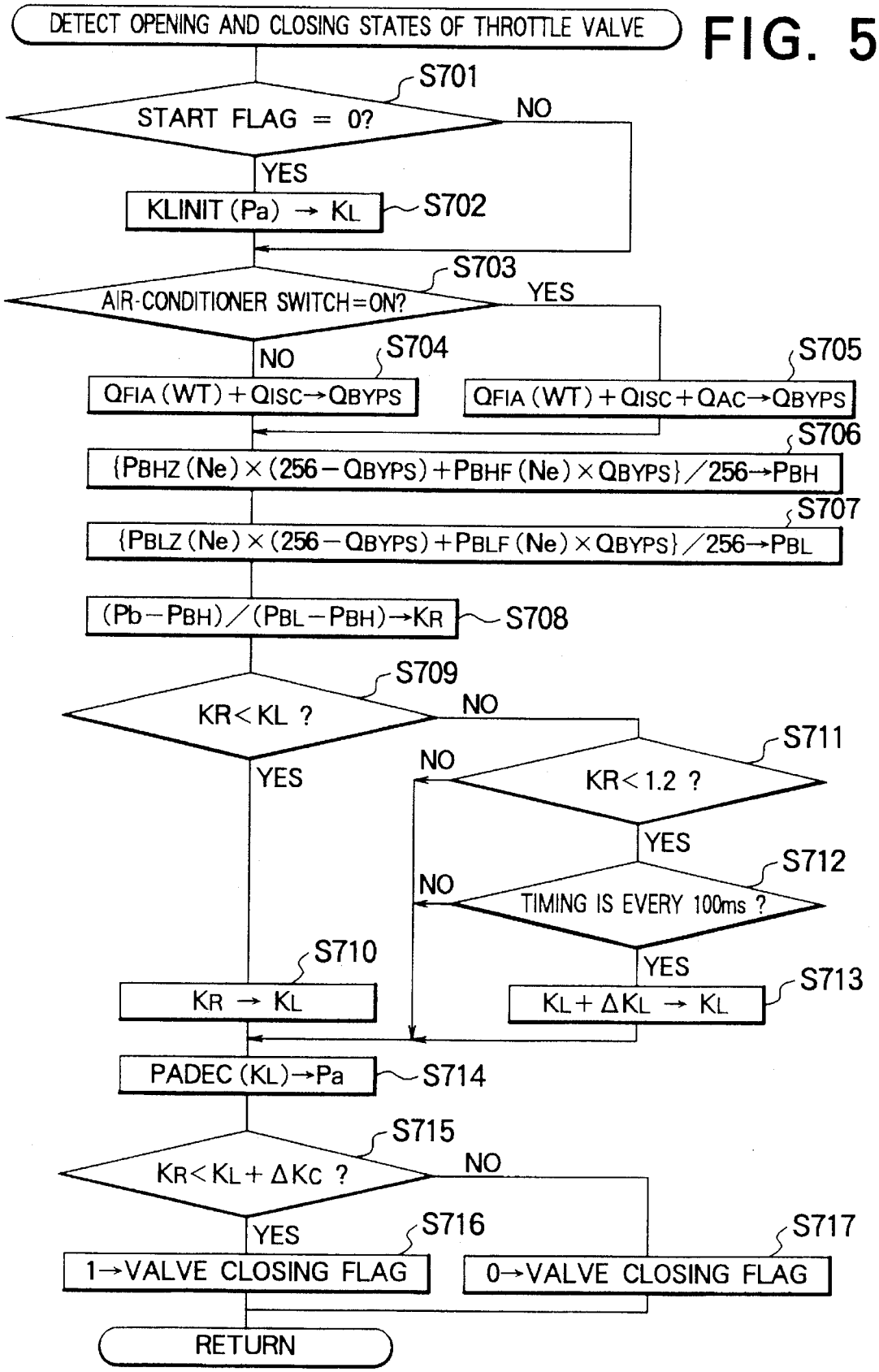
FIG. 5 is a flow chart of the processing of step S7 in the flow chart of FIG. 3.

In step S7, the atmospheric pressure during the reduction of the speed is detected (details are shown in FIG. 5) so as to find the atmospheric pressure Pa. Also, if it is determined that the throttle valve is in the closed state, the valve closing flag is set to 1. On the other hand, if it is determined that the throttle valve is not in the closed state, the valve closing flag is reset to 0. Subsequently, the flow proceeds to step S8 in which the start flag is set to 1 in order to indicate the completion of the initialization of the RAM 205. In step S9 the controlling of the engine speed at idle is processed (details are shown in FIG. 4).

The flow further proceeds to step S10 in which the engine speed Ne and the air-intake tube pressure Pb are used to form a two-dimensional map so as to determine the volumetric efficiency CEV (Ne, Pb). Then, in step S11 the cooling water temperature WT is used to form a linear-dimensional map so as to determine the coefficient of the warm-up amount CWT (WT). The flow further proceeds to step S12 in which the basic drive duration of the injector 15 is found by the following equation TPWO using the constant K, the air-intake tube pressure Pb, the volumetric efficiency CEV and the coefficient of the warm-up amount CWT.

$$TPWO=K\times Pb\times CEV\times CWT$$

In step S13 it is determined whether the air-intake pressure Pb is equal to or greater than the value obtained by subtracting a predetermined value APE from the detected atmospheric pressure Pa. If the answer in step S13 is YES, that is, $Pb \geqq Pa-\Delta PE$, it is determined that the air-fuel mixture is in the enriching region. Then, the flow proceeds to step S14 in which the drive duration TPW is found from the basic drive duration TPWO and the enriching air-fuel mixture correction coefficient KER (for example, 1.15) according to the expression: $TPW=TPWO\times KER$ so as to be stored in the RAM 205. On the other hand, if the answer in step S13 is NO, that is, $Pb<Pa-\Delta PE$, the flow proceeds to step S15 in which the basic drive duration TPWO is determined as the drive duration TPW, which is then stored in the RAM 205. The calculated drive duration TPW is synchronized with the occurrence of the ignition signal and is set at the timer 202 so that the timer 202 is permitted to operate for the duration designated by the drive duration TPW. After completing the processing in steps S14 and S15, the flow returns to step S2, and the foregoing operation is repeated.

A detailed explanation will now be given of the processing executed in step S9 shown in FIG. 3 with reference to FIG. 4. In step S90 it is determined whether the valve closing flag is 1, that is, whether the throttle valve 4 is in the closed state. If the answer in step S90 is YES, the flow proceeds to step S91 in which it is determined whether the cooling water temperature WT is equal to 70° C. or higher, that is, whether the engine 1 is sufficiently warmed up. If the answer in step S91 is YES, the flow proceeds to step S92 in which it is determined whether the air conditioner switch 12 is ON, that is, whether the air conditioner (not shown) is driven by the engine 1. If the answer in step S92 is NO, the flow proceeds to step S93 in which the targeted engine speed data Nt indicating the targeted engine speed is set to equal 800 rpm. If the answer in step S92 is YES, the flow proceeds to step S94 in which the targeted engine speed data Nt is set to equal 1000 rpm. In step S95 it is determined whether the timing is set at every 100 ms. If the answer in step S95 is NO, the process of controlling the engine speed at idle is completed. If the answer in step S95 is YES, the flow proceeds to step S96 in which the deviation $\Delta N$ between the targeted engine speed data Nt and the real engine speed data Ne is found to obtain the control gain KI for achieving the targeted engine speed by forming the linear map of the deviation $\Delta N$ shown in FIG. 6.

Figure 6:
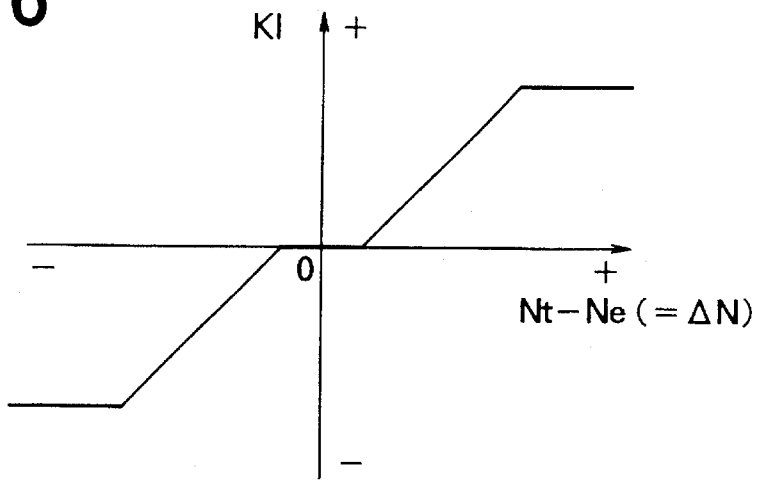
FIG. 6 is a diagram indicative of the relationship of a deviation between targeted engine speed data and real engine speed data in relation to a control gain.

As illustrated in FIG. 6, the relationship between the deviation $\Delta N$ and the control gain KI is as follows. As the deviation AN increases or decreases from zero, the control gain KI remains zero in the dead zone and, from certain points, starts to be proportional-to the deviation $\Delta N$. When the deviation $\Delta N$ further increases or decreases, the control gain KI is limited so as not to diverge.

Figure 7:
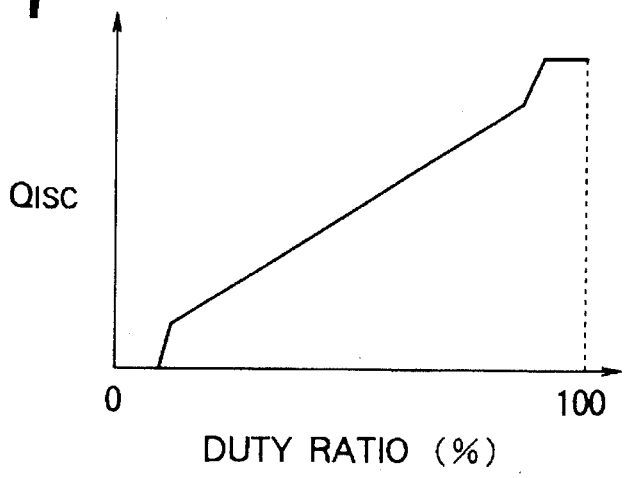
FIG. 7 is a diagram indicative of the relationship between the idle speed control air flow rate and a duty ratio of a drive signal.

In step S97 the control gain KI obtained in step S96 is added to the previous value (100 ms before) of the ISC air flow rate QISC, which corresponds to the targeted air flow rate of the ISC bypass passage 10 adjusted by the ISC solenoid valve 13, thereby updating the ISC air flow rate QISC. In step S98, in accordance with the updated QISC, the linear map of the QISC shown in FIG. 7 is formed to find a drive signal duty ratio in order to achieve the targeted air flow rate by driving the ISC solenoid valve 13, thus completing the process of controlling the engine speed at idle.

Figure 8:
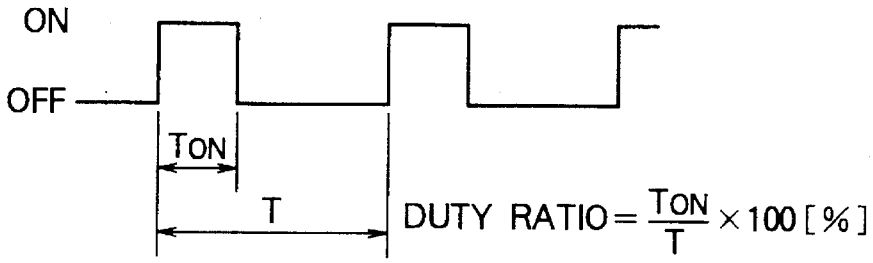
FIG. 8 is an illustration of the duty ratio.

As illustrated in FIG. 8, such a drive signal duty ratio is given by the expression: TON/T×100[%] wherein the duration required for turning on the ISC solenoid valve 13 in one cycle is TON and the duration required for one cycle is T. The duty ratio and the opening amount of the ISC solenoid valve 13 are proportional to each other.

In contrast thereto, if it is determined in step S90 that the throttle valve 4 is not in the closed state, or if it is determined in step S91 that the engine 1 is not sufficiently warmed up, the flow proceeds to step S99 in which the ISC air flow rate is set to be a predetermined value QOPEN in order to achieve the targeted air flow rate in controlling the opened throttle valve. Afterwards, the flow proceeds to Step S98 in which processing similar to that described above is executed, thus completing the process of controlling the engine speed at idle.

Figure 9:
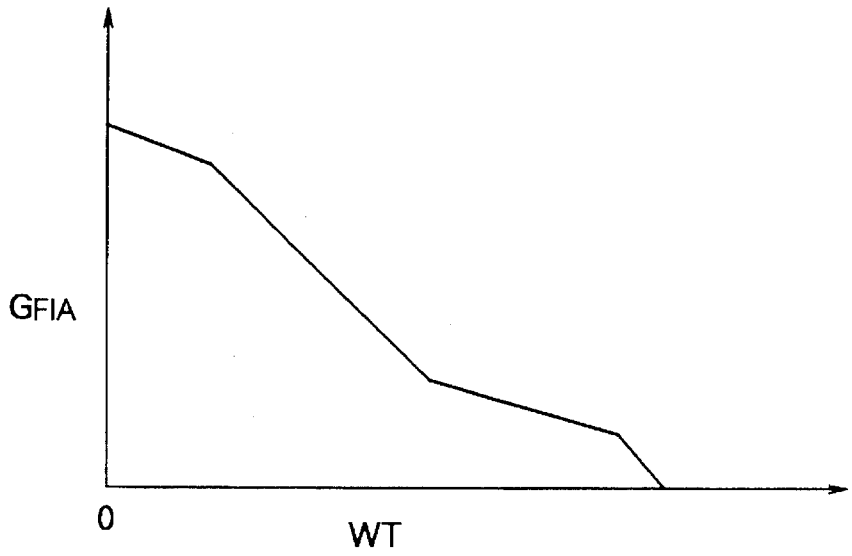
FIG. 9 is a diagram indicative of the relationship between the cooling-water temperature and the fast idle air flow rate.
Figure 10:
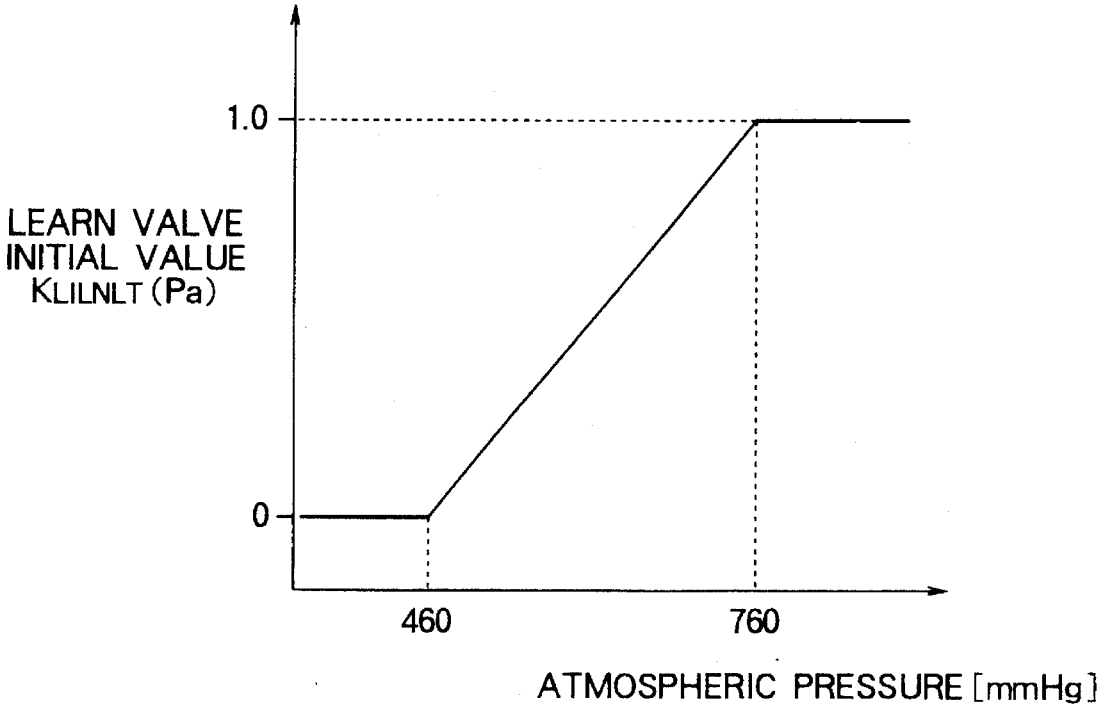
FIG. 10 is a diagram indicative of the relationship between the atmospheric pressure and the initial value of the learn value according to the embodiment of the present invention.
Figure 11:
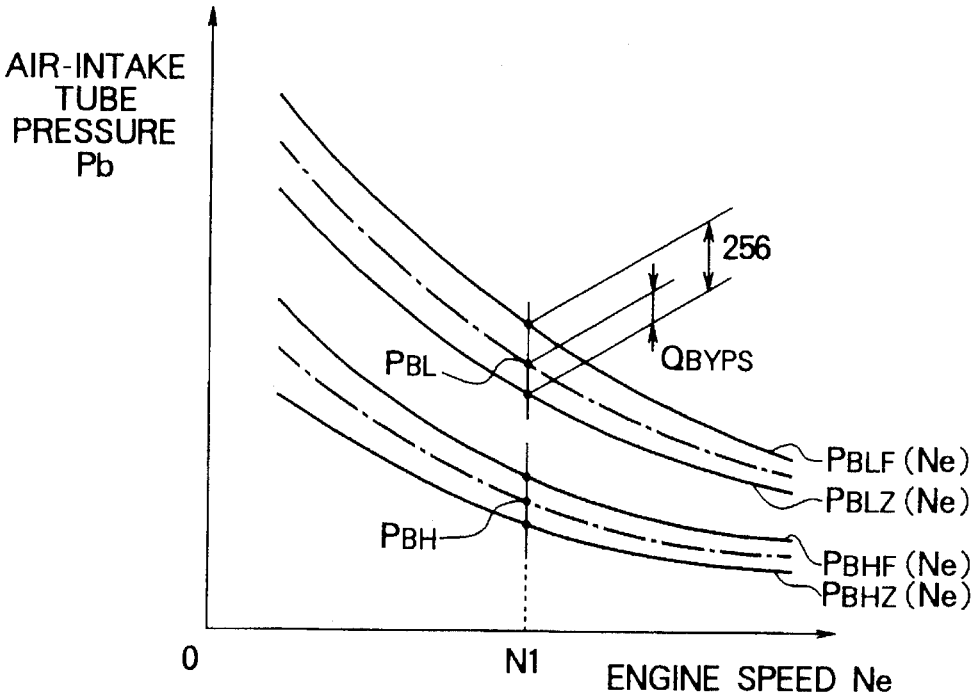
FIG. 11 is a diagram illustrative of the bypass air flow rate and the air-intake pressure when the valve is completely closed according to the embodiment of the present invention.

A detailed explanation will now be given of the process executed in step S7 of FIG. 3 with reference to operation diagrams of FIGS. 9–14 and a flow chart of FIG. 5. The atmospheric pressure can be detected during speed reduction by making the use of the following fact. That is, the air-intake tube pressure when the throttle valve is closed (hereinafter referred to as the valve-closed air-intake pressure) varies according to the atmospheric pressure. In order to make use of this fact, the following pressures have first been stored in the ROM 206: a typical valve-closed air-intake pressure PBLZ (Ne) at a low altitude (for example, an atmospheric pressure of 760 mmHg at an altitude of 0 m) when the bypass air flow rate is 0; a typical valve-closed air-intake pressure PBLF (Ne) at such a low altitude when the bypass air flow rate is 256 liter/minute; a typical valve-closed air-intake pressure PBHZ (Ne) at a high altitude (for example, an atmospheric pressure of 460 mmHg at an altitude of 4000 m) when the bypass air flow rate is 0; and a typical valve-closed air-intake pressure PBHF (Ne) at such a high altitude when the bypass air flow rate is 256 liter/minute, the foregoing pressures varying according to the engine speed. Then, the air flow rate QBYPS of the bypass air-intake passage 6 which is arranged to bypass the throttle valve 4 of the engine 1 is estimated by calculation. Further, as illustrated in FIG. 11, corresponding to the detected engine speed (Ne=N1), the low-altitude valve-closed air-intake pressure PBL according to the bypass air flow rate QBYPS and the high-altitude valve-closed air-intake pressure PBH according to the bypass air flow rate QBYPS are calculated based on the following mathematical equations 1 and 2:

$$PBL=\{PBLZ(Ne)\times(256-QBYPS)+PBLF(Ne)\times QBYPS\}/256 \quad \text{mathematical equation 1}$$

$$PBH=\{PBHZ(Ne)\times(256-QBYPS)+PBHF(Ne)\times QBYPS\}/256 \quad \text{mathematical equation 2}$$

Figure 12:
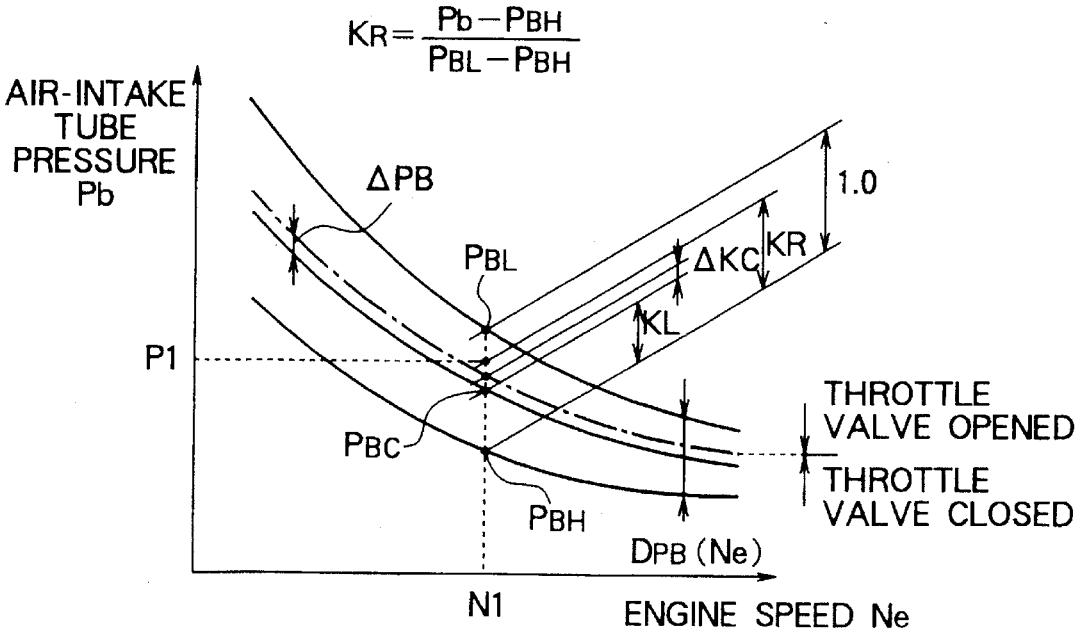
FIG. 12 is a diagram illustrative of the air-intake pressure when the valve is completely closed according to the embodiment of the present invention.

Subsequently, as illustrated in FIG. 12, corresponding to the detected air-intake tube pressure (Pb=P1), the parameter KR is calculated based on the following mathematical equation 3:

$$KR=(Pb-PBH)/(PBL-PBH) \quad \text{mathematical equation 3}$$

Moreover, based on this parameter KR, the following learn value KL is found: the interpolation coefficient (1.0 at a low altitude and 0 at a high altitude) in relation to the low-altitude valve-closed air-intake pressure PBL and the high altitude valve-closed air-intake pressure PBH of the valve-closed air-intake pressure according to the atmospheric pressure to be detected. More specifically, as illustrated in FIGS. 13(*a*), 13(*b*), and 13(*c*), when the atmospheric pressure decreases during ascension, the parameter KR obtained when the throttle valve is closed is also lowered. By making use of this fact, when the parameter KR is smaller than the learn value KL, such a learn value KL is updated to the parameter KR (indicated by the portion A shown in FIG. 13(*c*). In contrast thereto, in order to cope with an increase in the atmospheric pressure during descending, the following processing is executed. It is determined whether the parameter KR is smaller than a predetermined value (basically 1.0). If the answer is YES, it is determined that the vehicle might be decelerated in order to descend, and the learn value KL is gradually increased (indicated by the portion B shown in FIG. 13(*c*)). The above-mentioned predetermined value is set to be greater than 1.0, for example, 1.2 in consideration of the assumption that the air-intake tube pressure during the reduction of the engine speed has a variation within approximately 20% depending on the engine. The rate of a gradual increase in the learn value KL is set to correspond to a typically-feasible speed at which an altitude is changed from high to low (for example, descending 1000 m for 30 minutes).

Referring back to FIG. 12, PBC is given by the equation: PBC=PBH+(PBL−PBH)×KL, which is a predicted value of the valve-closed air-intake pressure in relation to the engine speed N1 and the bypass air flow rate QBYPS ΔKC indicates a tolerance which is allowed when it is determined the throttle valve is in the closed state by comparison of the parameter KR and the learn value KL, as will be mentioned below. Such a tolerance is set to be, for example, approximately 0.3.

Subsequently, through the use of a correlation between the foregoing learn value KL and the atmospheric pressure, as illustrated in FIG. 14, the atmospheric pressure Pa is detected based on the function PADEC (Pa) of the type in which the detected atmospheric pressure Pa is 460 mmHg when the learn value KL is 0 and the detected atmospheric pressure Pa is 760 mmHg when the learn value is 1.

The foregoing operation will now be described with reference to the flow chart of FIG. 5. In step S701 it is first determined whether the start flag is 0. If the answer in step S701 is YES, the flow proceeds to step S702. In step S702 the linear-dimensional map of the detected atmospheric pressure Pa determined in step S6 of FIG. 3 is formed as shown in FIG. 10. From this map, the initial value KLINIT (Pa) of the learn value KL is determined so as to be stored in the RAM 205 as the learn value KL. If it is determined in step S701 that the start flag is 1, or upon completion of the processing of step S702, the flow proceeds to step S703.

In step S703 it is determined whether the air conditioner switch 12 is ON or OFF. If it is OFF, the A/C bypass passage 9 has been completely closed by the ACIUS valve 11. Accordingly, in step S704 the linear-dimensional map of the cooling-water temperature WT is formed as shown in FIG. 9. From this map, the FIA air flow rate QFIA (WT) corresponding to the air flow rate of the FIA passage 6*a* controlled by the FIA valve 7 is determined. Then, the foregoing ISC air flow rate QISC corresponding to the air flow rate of the bypass passage 10 determined in step S9 of FIG. 3 is added to the above-mentioned FIA air flow rate QFIA (WT) so as to find the overall bypass air flow rate QB YPS corresponding to the air flow rate of the bypass air passage 6. Such a flow rate QBYPS is stored in the RAM 205.

In contrast thereto, if the air conditioner switch 12 is ON in step S703, the A/C bypass passage 9 has been fully opened by the ACIUS valve 11. Accordingly, in step S705 the FIA air flow rate QFIA (WT) is determined in a manner similar to step S704, and the ISC air flow rate QISC is added to the FIA air flow rate QFIA (WT). Further, added to the resultant value is the A/C air flow rate QAC corresponding to the air flow rate of the A/C bypass passage 9 which rate has been stored in the ROM 206 so as to find the bypass air flow rate QBYPS corresponding to the air flow rate of the overall bypass air passage 6. Such a flow rate QBYPS is stored in the RAM 205.

Upon completion of the processing of steps S704 and S705, the flow proceeds to step S706 in which the high-altitude valve-closed air-intake pressure PBH in response to the bypass air flow rate QBYPS is determined according to the foregoing mathematical equation 2 from the foregoing bypass air flow rate QBYPS, the typical valve-closed air-intake pressure PBHZ (Ne) at a high altitude when the bypass air flow rate is 0 and the typical valve-closed air-intake pressure PBHF (Ne) at such a high altitude when the bypass air flow rate is 256 liter/minute, the air-intake pressures PBHZ (Ne) and PBHF (Ne) varying according to the engine speed. The high-altitude valve-closed air-intake pressure PBH which has thus been determined is then stored in the RAM 205.

The flow further proceeds to step S707 in which the low-altitude valve-closed air-intake pressure PBL in response to the bypass air flow rate QBYPS is determined according to the foregoing mathematical equation 1 from the foregoing bypass air flow rate QBYPS, the typical valve-closed air-intake pressure PBLZ (Ne) at a low altitude when the bypass air flow rate is 0 and the typical valve-closed air-intake pressure PBLF (Ne) at such a low altitude when the bypass air flow rate is 256 liter/minute, the air-intake pressures PBLZ (Ne) and PBLF (Ne) varying according to the engine speed. The low-altitude valve-closed air-intake pressure PBL which has thus been determined is then stored in the RAM 205.

In step S708, the parameter KR is calculated according to the foregoing mathematical equation 3 from the air-intake tube pressure Pb, the high-altitude valve-closed air-intake pressure PBH and the low-altitude valve-closed air-intake pressure PBL. Then, the calculated parameter KR is stored in the RAM 205.

In step S709 it is determined whether the parameter KR is smaller than the learn value KL. If the answer in step S709 is YES, that is, if KR<KL, the flow proceeds to step S710 in which the learn value KL is updated to the parameter KR (indicated by the portion A in FIG. 13(*c*)), and the flow proceeds to step S714.

On the other hand, if the answer in step S709 is NO, that is, KR≧KL, the flow proceeds to step S711 in which it is determined whether the parameter KR is smaller than a predetermined value 1.2. If the answer in step S711 is YES, that is, KR<1.2, the flow proceeds to step S712 in which it is determined whether the timing is every 100 ms. If the answer in step S712 is YES, the flow proceeds to step S713 in which a predetermined value ΔKC is added to the learn value KL, which is thus updated (indicated by the portion B in FIG. 13(*c*)), and the flow further proceeds to step S714.

In contrast thereto, if the answer in step S711 is NO, that is, KR> 1.2, or if it is determined in step S712 that the timing is not every 100 ms, the learn value KL is not updated, and the flow proceeds to step S714.

In step S714, the linear-dimensional map of the learn value KL is formed as shown in FIG. 14, and the determined value PADEC (KL) is stored in the RAM 205 as the atmospheric pressure Pa.

Subsequently, the flow proceeds to step S715 in which the parameter KR is compared with the value obtained by adding a predetermined value ΔKC to the learn value KL. If it is determined in step S715 that KR<KL+ΔKC, the flow proceeds to step S716 in which the valve closing flag is set to 1 in order to indicate that the throttle valve is in the closed state. On the other hand, if it is determined that KR≧KL+ΔKC in step S715, the flow proceeds to step S717 in which the valve closing flag is reset to 0 in order to indicate that the throttle valve is not in the closed state. Upon completion of the processing of steps S716 and S717, the flow returns to the processing shown in FIG. 3.

As described above, in the first embodiment the atmospheric pressure Pa is detected by the following process. The ratio of a value obtained by subtracting the high-altitude valve-closed air-intake pressure PBH from the air-intake tube pressure Pb in relation to a value obtained by subtracting the high-altitude valve-closed air-intake pressure PBH from the low-altitude valve-closed air-intake pressure PBL is calculated as the parameter KR. When such a parameter KR is smaller than the learn value KL, the parameter KR is stored as the learn value KL. When the parameter KR is equal to or greater than the learn value KL and is also smaller than a predetermined value (1.2), the learn value KL is gradually increased. The atmospheric pressure Pa is thus determined based on the resultant learn value KL. However, the atmospheric pressure Pa may be detected by the following process. A value obtained by subtracting the high-altitude valve-closed air-intake pressure PBH from the low-altitude valve-closed air-intake pressure PBL has been stored in the ROM 206 as a valve-closed air-intake pressure deviation ΔP. A ratio of a value obtained by subtracting the high-altitude valve-closed air-intake pressure PBH from the air-intake tube pressure Pb in relation to the deviation ΔP is calculated as a parameter KR. When the parameter KR is smaller than the learn value KL, such a parameter KR is stored as the learn value KL. Conversely, when the parameter KR is equal to or greater than the learn value KL and is also smaller than a predetermined value (1.2), the learn value KL is gradually increased and then stored. The atmospheric pressure Pa may thus be detected based on the learn value KL.

What is claimed is:

1. An engine-controlling atmospheric pressure detection system comprising:

engine speed calculation means for calculating a speed of an engine;

pressure detection means for detecting air-intake tube pressure of said engine;

first pressure calculation means for calculating a first pressure according to at least said engine speed, said first pressure being associated with the air-intake tube pressure when a throttle valve of said engine is closed;

second pressure calculation means for calculating a second pressure according to at least said engine speed, said second pressure being associated with the air-intake tube pressure when said throttle valve of said engine is closed;

parameter calculation means for calculating a parameter which indicates the relationship of said air-intake tube pressure in relation to said first and second pressures;

learn value calculation means for processing said parameter in time sequence by calculation so as to determine a typical value of said parameter and to store said typical value as a learn value; and atmospheric pressure calculation means for calculating an atmospheric pressure based on said learn value.

2. An engine-controlling atmospheric pressure detection system according to claim 1 wherein said first pressure calculation means calculate as said first pressure a value associated with the air-intake tube pressure at a high altitude when said throttle valve is closed and wherein said second pressure calculation means calculate as said second pressure a value associated with the air-intake tube pressure at a low altitude when said throttle valve is closed.

3. An engine-controlling atmospheric pressure detection system according to claim 2 wherein said first pressure is calculated based on typical valve-closed air-intake pressures PBHZ (Ne) and PBHF (Ne) when a bypass air flow rate is 0 and 256 liter/minute, respectively, at an atmospheric pressure of 460 mmHg and at an altitude of 4000 m, said pressures PBHZ (Ne) and PBHF (Ne) having been stored as high altitude air-intake tube pressures.

4. An engine-controlling atmospheric pressure detection system according to claim 2 wherein said second pressure is calculated based on typical valve-closed air-intake pressures PBLZ (Ne) and PBLF (Ne) when a bypass air flow rate is 0 and 256 liter/minute, respectively, at an atmospheric pressure of 760 mmHg and at an altitude of 0 m, said pressures PBLZ (Ne) and PBLF (Ne) having been stored as low altitude air-intake tube pressures.

5. An engine-controlling atmospheric pressure detection system according to claim 1 wherein said parameter calculation means calculate as a parameter a ratio of a value obtained by subtracting said first pressure from said air-intake tube pressure in relation to a value obtained by subtracting said first pressure from said second pressure, said learn value calculation means storing, when said parameter is smaller than said learn value, said parameter as the learn value, said learn value calculation means increasing, when said parameter is not smaller than said learn value and is also smaller than a predetermined value, said learn value and storing it.

6. An engine-controlling atmospheric pressure detection system according to claim 1 wherein said atmospheric pressure calculation means determine an atmospheric pressure by forming a map of said learn value.

7. An engine-controlling atmospheric pressure detection system according to claim 1 wherein said atmospheric pressure calculation means determine the atmospheric pressure when said learn value is 0 as said atmospheric pressure at a high altitude and determine the atmospheric pressure when said learn value is 1 as said atmospheric pressure at a low altitude.

* * * * *